United States Patent [19]

Davison

[11] 4,430,176

[45] Feb. 7, 1984

[54] ELECTROLYTIC PROCESS FOR PRODUCING HYDROGEN PEROXIDE

[75] Inventor: John B. Davison, Mission Viejo, Calif.

[73] Assignee: Occidental Chemical Corporation, Niagara Falls, N.Y.

[21] Appl. No.: 321,286

[22] Filed: Nov. 13, 1981

[51] Int. Cl.[3] ..... C25B 1/30

[52] U.S. Cl. ..... 204/84; 204/284; 204/294

[58] Field of Search ..... 204/84, 294, 284

[56] References Cited

U.S. PATENT DOCUMENTS

| | | | |
|---|---|---|---|
| 2,000,815 | 5/1935 | Berl | 204/84 |
| 3,389,073 | 6/1968 | Vaught et al. | 204/294 |
| 3,477,940 | 11/1969 | Grangaard | 204/294 |
| 3,726,738 | 4/1973 | Gellon et al. | 204/294 |
| 3,856,640 | 12/1974 | Halfar et al. | 204/294 |
| 3,969,201 | 7/1976 | Oloman et al. | 204/84 |
| 4,067,787 | 1/1978 | Kastening et al. | 204/84 |
| 4,118,305 | 10/1978 | Oloman et al. | 204/95 |
| 4,133,738 | 1/1979 | Will | 204/294 |
| 4,142,949 | 3/1979 | Faul et al. | 204/294 |
| 4,235,695 | 11/1980 | Denora et al. | 204/294 |
| 4,294,893 | 10/1981 | Iemmi et al. | 204/294 |

*Primary Examiner*—T. Tung

*Attorney, Agent, or Firm*—James F. Tao; William G. Gosz

[57] ABSTRACT

An electrolytic process for producing hydrogen peroxide in an aqueous alkaline solution includes simultaneously passing an aqueous alkaline electrolyte and oxygen through a fluid permeable conductive cathode comprising reticulated vitreous carbon foam, separating the fluid permeable conductive cathode from an anode by a barrier and connecting the fluid permeable conductive electrode and the anode with an external power source to cause generation of hydrogen peroxide ion within the aqueous alkaline solution.

5 Claims, 4 Drawing Figures

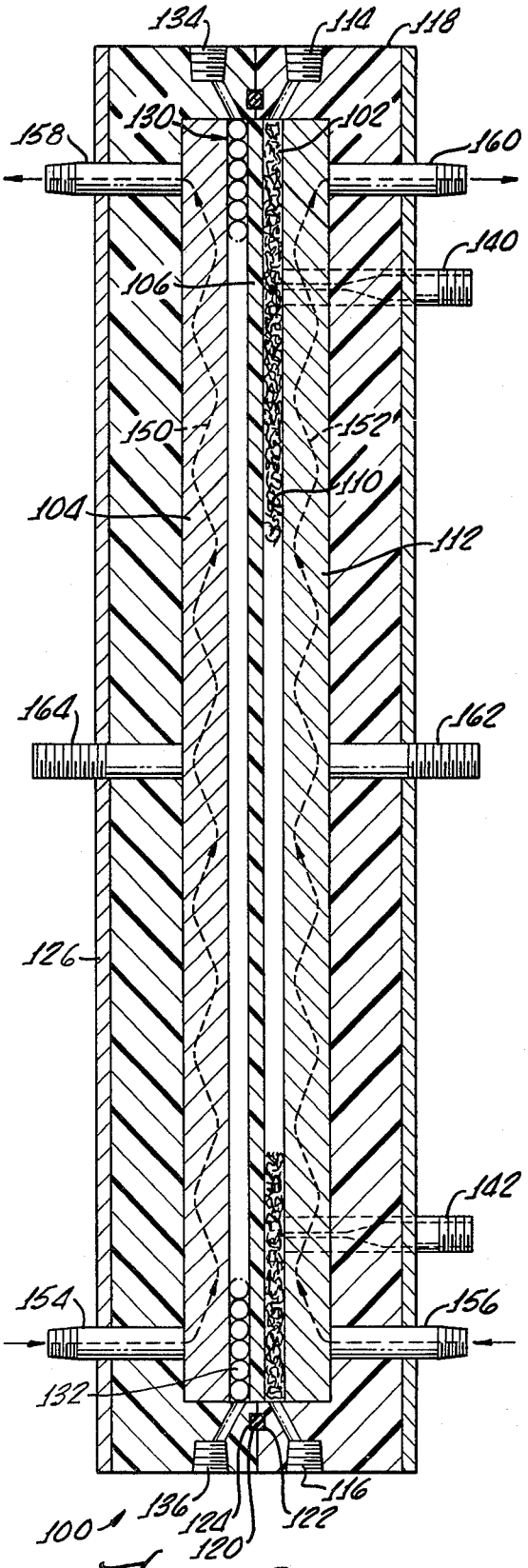
FIG. 2.
FIG. 3a.
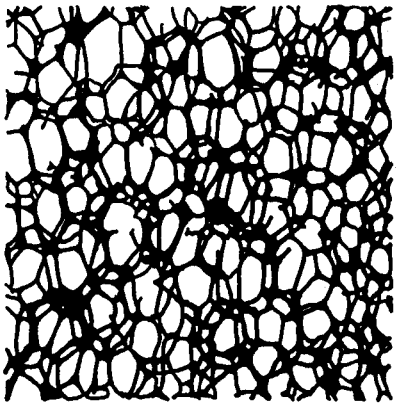
FIG. 3b.
(PRIOR ART)
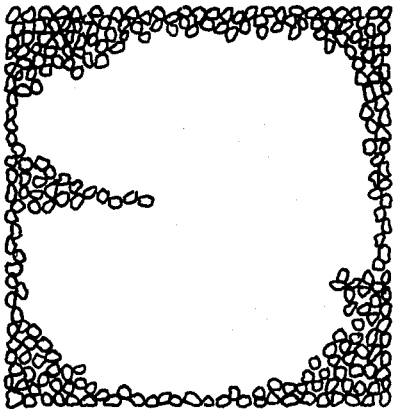

ELECTROLYTIC PROCESS FOR PRODUCING HYDROGEN PEROXIDE

The present invention relates generally to a method and apparatus for the preparation of alkaline oxide solutions and in particular relates to a method and apparatus for the production of alkaline peroxide solutions in an electrolic cell having a cathode in the form of a fluid permeable conductive mass, in which alkaline solution and oxygen are passed therethrough.

Hydrogen peroxide has been used as a strong chemical oxidizing agent and alkaline solutions thereof have particular use in the bleaching of wood pulp. The bleaching properties of hydrogen peroxide are particularly important in the environmently concious world of today, because the oxidizing reaction between hydrogen peroxide and reduceable reactants yields a non-polluting end product namely, water.

When used in the paper pulp industry, on-site installation of a manufacturing facility for the production of hydrogen peroxide produced thereby may be useable directly without dilution or concentration thereof, and further, because of the unstable nature of hydrogen peroxide, losses due to decomposition during transportation from remote manufacturing sites are eliminated.

Many electrolytic processes and apparatus have been proposed for the production of alkaline solutions of hydrogen peroxide in on-site installations and have included various technological concepts such as the "trickle" cell proposed by Oloman in U.S. Pat. Nos. 3,969,201 and 4,118,305. In these patents there is described a method and apparatus for passing an aqueous alkaline electrolyte and oxygen simultaneously through a fluid permeable conductive mass forming a cathode in a direction normal to the electric current flow through the cathode.

While this cell describes a method and apparatus for the production of hydrogen peroxide, the current efficiency of the cell in the production of hydrogen peroxide is low. In fact, as reported in the Oloman patents, the highest current efficiency for the production of any substantial amount of $H_2O_2$, namely 0.5 wt. % $H_2O_2$, is approximately 21% in a single compartment (diaphragm) cell.

In a two compartment (membrane) cell Oloman reports current efficiencies over 70%, but at hydrogen peroxide production levels of only 0.0022 gr. mol. per liter of hydrogen peroxide or about 0.07 wt % $H_2O_2$.

The current efficiency of an electrolytic cell is important both for the conservation of energy in the production of hydrogen peroxide, but also in the size of the cell necessary to produce efficient hydrogen peroxide to meet the needs of a typical wood pulp bleaching insulation.

For example, a typical wood pulp bleaching installation may require 100,000 lbs. of hydrogen peroxide on a yearly basis, or 333 lbs/day based on 24 hours operation for 300 days per year. Based on cell current efficiencies of about 21% for producing apparatus for the production of 100,000 lbs. of hydrogen peroxide per year would require approximately 2,000 cells having bed dimensions of approximately 42 by 5 cm, or approximately 500 square feet of bed area, the overall size of the electrolytic cell installation and associated equipment being considerably larger.

It has now been determined that the current efficiency of the Oloman type cells is limited in part by the type cathode used therein, namely a cathode mass formed from a bed of particles or a fixed porous matrix of carbon. While generally described in the Oloman patents that the porous bed must be composed of a conducting material, which is good electrocatalyst for the reduction of oxygen peroxide, no cathode material has been found heretofore that has enabled the cell to operate at high current efficiency while producing hydrogen peroxide.

SUMMARY OF THE INVENTION

It has been found, that a particular form of carbon, namely reticulated vitreous carbon, when incorporated into a "trickle" type cell as a cathode, enables the production of hydrogen peroxide at higher concentrations in an electrolytic cell at greater current efficiencies than heretofore experienced. Further, such results are not expected because of the high void volume present in the reticulated vitreous carbon.

It was shown in U.S. Pat. Nos. 3,919,201 and 4,118,305 that an electrolytic solution flowing through a packed bed of particles forms a thin liquid film around each particle of the cathode electrode and oxygen gas diffusion into the thin film enables a reaction forming hydrogen peroxide within the thin film. The present discovery is directed to the use of a reticulated vitreous carbon foam electrode which is substituted for the carbon bed which enables greater concentrations of hydrogen peroxide at far greater cell efficiencies. The results of the present invention are unexpected because of the high void volume in the reticulated vitreous carbon foam electrode.

It would be expected that an increased volume to surface area within the electrode, would act to dilute the concentration of the hydrogen peroxide produced. Since the reaction forming hydrogen peroxide occurs near the electrode surface, the bulk of the fluid in the voids does not enter into the reaction forming hydrogen peroxide and further acts to dilute the concentration of the hydrogen peroxide produced within the electrode.

Hence, the present invention is directed to an electrolytic process for producing hydrogen peroxide in an aqueous alkaline solution which comprises, simultaneously passing an aqueous alkaline electrolyte and oxygen through a fluid permeable conductive cathode comprising reticulated vitreous carbon foam, separating the fluid permeable conductive cathode from an anode by a barrier and connecting the fluid permeable conductive electrode and the anode with an external power source to cause generation of hydrogen peroxide ion within the aqueous alkaline solution.

More particularly, an electrolytic process for producing hydrogen peroxide in a sodium hydroxide solution includes introducing oxygen into an aqueous sodium hydroxide solution to form an electrolyte; passing said electrolyte at a pressure of approximately 250 psig through a fluid permeable cathode comprising reticulated vitreous carbon foam; separating said fluid permeable cathode from an anode compartment by a membrane impermeable to $HO_2^-$ and $OH^-$ ions; passing sodium hydroxide solution through the anode compartment; connecting said fluid permeable cathode and said anode with an external power source for causing electrical current to flow through between the fluid permeable cathode and the anode in a direction perpendicular to the direction of the flow of electrolyte through the fluid permeable cathode, causing the electrical current density on the fluid permeable cathode to be at least 400 amperes per square meter and generating hydrogen peroxide ion within the aqueous alkaline solution at a current efficiency of at least 85 percent; withdrawing from the fluid permeable cathode, sodium hydroxide solution having at least 1.5 percent by weight hydrogen peroxide therein.

BRIEF DESCRIPTION OF THE DRAWINGS

The advantages and features of the present invention may be appreciated more fully when taken in conjunction with the following drawings in which:

FIG. 2 is a cross section view of an alternative embodiment of the present invention showing an electrolytic cell of the "trickle" type having both a cathode compartment filled with a reticulated vitreous carbon foam and an anode compartment filled with glass beads for supporting a membrane disposed between the anode and cathode compartments; and, FIGS. 3*a* and 3*b* cross sections of reticulated vitreous carbon foam and a packed bed respectively, showing the relative sizes of the particles and voids therein respectively.

DETAILED DESCRIPTION

Figure 1:
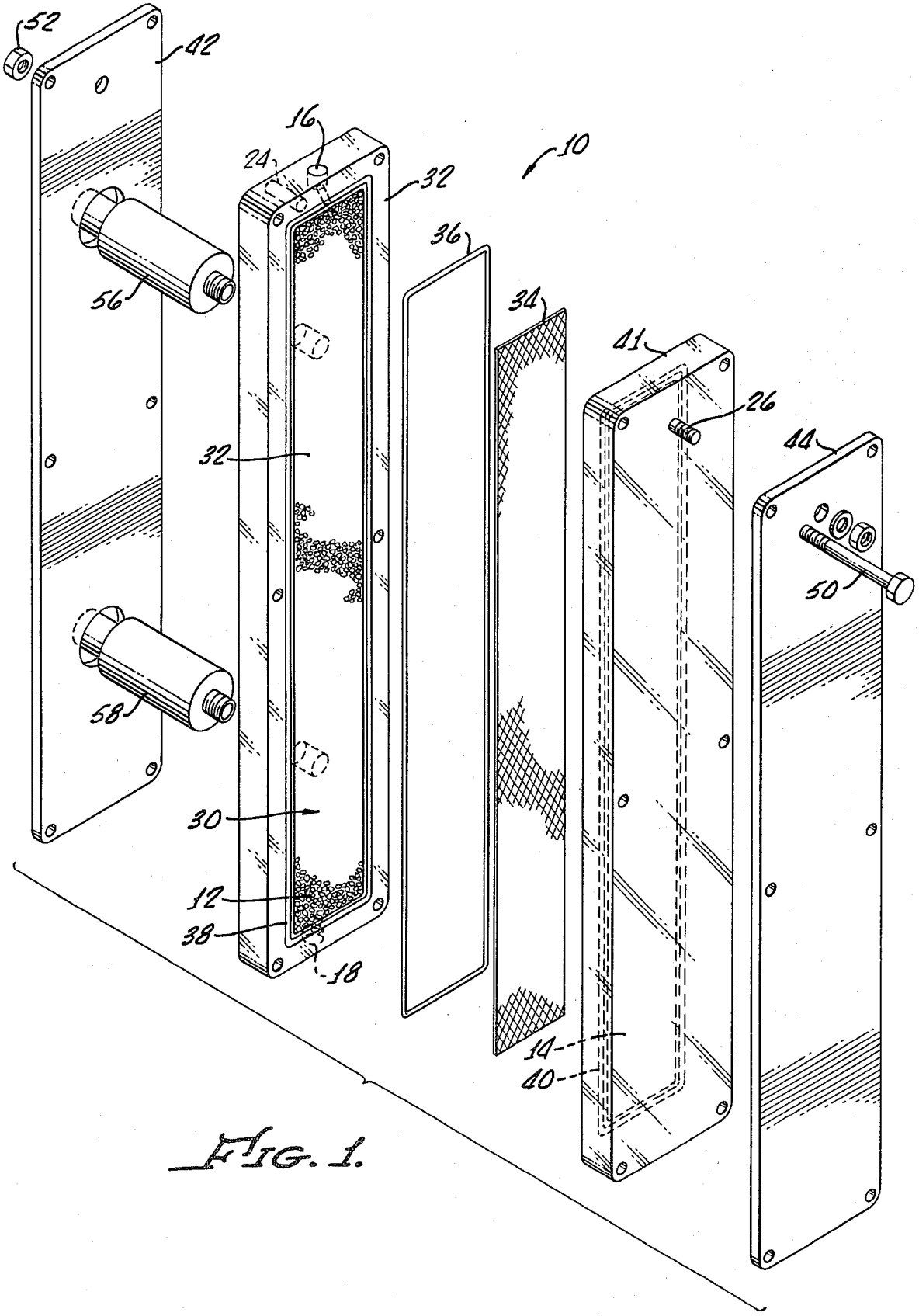
FIG. 1 is an exploded perspective view of one embodiment of the present invention showing an electrolytic cell of the "trickle" type having a cathode compartment filled with a reticulated vitreous carbon foam.

Turning now to FIG. 1, there is shown an electrolytic cell 10 for producing hydrogen peroxide in accordance with the electrolytic process of the present invention.

In general, the electrolytic cell 10 includes a fluid permeable conductive cathode 12, and anode 14, means including an inlet 16, and an outlet 18, for passing an aqueous alkaline electrolyte and oxygen through the fluid permeable conductive cathode 12, and means including a cathode connection 24 and an anode connection 26, for interconnecting the fluid permeable conductive cathode 12, and the anode 14, with an external power source (not shown).

A cathode chamber 30 is formed between a stainless steel cathode feeder plate 32, and a barrier wall 34, which may be porous polypropylene felt diaphragm, which is supported by the anode 14. The anode 14 also may be formed from a stainless steel plate.

The cathode chamber 30 is sealed by an O-ring 36 fitted into channels 38, 40 disposed on the cathode feeder plate 32 and a plexiglass, or plastic, body 41 surrounding the anode plate 14.

Structural support is provided to the cathode feeder plate 32 barrier wall 34 and anode plate 14 by two steel pressure plates 42, 44 which are bolted or fastened together with the cathode feeder plate 32, barrier wall 34, and anode plate 14 therebetween. Conventional bolts 50 and nuts 52 may be employed to provide adequate pressure between the pressure plates 42 and 44 in order that pressures of up to 250 psig may be maintained within the cathode chamber 30. Reference electrodes 56, 58 may be inserted into the cathode chamber 30 in contact with the fluid permeable conductive cathode 12 for the measurement of cathode potentials.

In operation, the aqueous alkaline electrolyte, which may be sodium hydroxide and gaseous oxygen, or air, are mixed prior to entering the inlet 16 of the cathode chamber 30. Upon entering the cathode chamber the mixture of alkaline electrolyte and gaseous oxygen is "trickled" down through the fluid permeable conductive cathode 12 whereupon the alkaline electrolyte wets the surface areas of the cathode 12 forming a thin film thereon through which the oxygen gas diffuses to the surface of the electrode. In order to increase the oxygen soluability in the alkaline electrolyte film operating pressures within the cathode chamber 30 are maintained at approximately 250 psig.

The barrier wall 34 provides a physical barrier to the migration of hydrogen peroxide from the cathode chamber 30.

As is well known, hydrogen peroxide is formed by reducing oxygen with the carbon catalyst in accordance with the reaction:

$$O_2+H_2O+2e^-\rightarrow OH+HO_2 \quad (1)$$

Loss of product $HO_2^-$ can occur by electrochemical oxidation at the anode via reaction:

$$2HO_2^-\rightarrow H_2O+3/2O_2+2e^- \quad (2)$$

In the trickle-bed cell 10, the diaphragm 34 provides only a physical barrier to the migration of $HO_2^-$ to the anode 14. At low current densities, when relatively little $HO_2^-$ is being produced, the diaphragm 34 retards significant anodic loss of $HO_2^-$ before the catholyte is removed from the cell 10. However, when greater amounts of $HO_2^-$ are being formed (at higher current densities), the diaphragm 34 is only of limited value in preventing product oxidation.

It is desirable, at high current densities, to provide greater separation between the cathode 12, and the anode 14, by providing an anode compartment therebetween and substituting a membrane, such as Nafion, which is impermeable to $HO_2^-$ and $OH^-$ of ions, for the diaphragm, as shown in FIG. 2.

FIG. 2 shows an alternative embodiment of an electrolytic cell 100 for carrying out the process of the present invention, which generally includes a fluid permeable conductive cathode 102 comprising reticulated vitreous carbon foam, an anode 104, a membrane 106, impermeable to $HO_2^-$ and $OH^-$. As previously described in connection with the embodiment shown in FIG. 1, the fluid permeable conductive cathode 102, fills an cathode compartment or chamber 110, which is formed between a stainless steel cathode plate 112, and the membrane 106. Means, including an inlet 114, and an outlet 116, are provided in the plastic supporting body 118 for passing alkaline electrolyte and oxygen through the cathode 102, as hereinbefore described.

The chamber 110 and the electrolytic cell 100 are sealed by means of an O-ring 120 situated in grooves 122, 124 of the plexiglass body 118 and a metal pressure plate 126 to enable the cathode chamber to withstand pressures up to 250 psig. An anode chamber 130 is formed between the anode 104 and the Nafion membrane 106 which is filled with glass beads 132, or the like, for supporting the Nafion membrane within the electrolytic cell 100 when assembled. An inlet 134 and an outlet 136 are provided to the anode chamber 130 for passing an electrolyte therethrough which may be an alkaline solution comprising sodium hydroxide. As previously described, reference electrodes 140, 142 may be inserted into the fluid permeable cathode for measuring cathode potentials therein. In addition, both the anode plate 104 and the cathode plate 112 may be provided with channels 150, 152, or the like, and inlets 154, 156 and outlets 158, 160 for the passage of cooling fluid therethrough in order to maintain the temperature of the electrolytic cell at approximately 30° to approximately 60° C.

Operation of the embodiment shown in FIG. 2 is similar to that of FIG. 1, except that an anode electrolyte comprising an alkaline solution is continuously passed through the anode compartment 130 as the cell is operated when the cathode 112 and the anode 104 interconnected with an external power supply (not shown) through connectors 162, 164.

Of particular importance, in the present invention is the utilization of a reticulated vitreous carbon foam, such as is available from the Fluorocarbon Company, Process Systems Division of Anaheim, Calif. Since the use of this material significantly increases the current efficiency of the apparatus process of the present invention in the production of hydrogen peroxide. It would not be expected from the study of U.S. Pat. Nos. 3,969,201 and 4,118,305 or from general experience in electrochemical art, that reticulated vitreous carbon would be suitable as an electrode because of the large portion of voids therein as hereinabove discussed.

FIG. 3 shows a comparison of the structure of an open pore reticulated vitreous carbon foam (FIG. 3*a*) compared to the void space in a typical packed bed of carbon (FIG. 3*b*). FIG. 3*a* shows the reticulated carbon foam magnified approximately ten times in order to show the relative sizes of the void and solid areas. The void volume in the reticulated vitreous carbon may be as high as 97%, whereas the void volume in the packed carbon bed utilizing graphite chips having a mesh range of −10 to +16 is approximately 40%. Because of this larger void volume, it would be expected that the gas-diffusion through the liquid portions of alkaline electrolyte to surface areas of the carbon would not be as efficient as diffusion in the thin film and smaller void volume within a packed bed of graphite, thereby suggesting lower current efficiencies in the production of hydrogen peroxide. Further, it would also be expected that with a larger amount of electrolyte in the cathode the product would be diluted and the resistance of the cathode would be increased.

It has been found, however that the use of reticulated vitreous carbon foam for the fluid permeable cathode significantly increases the current efficiency of the cell particularly at high current densities and at high operating pressures, while producing higher concentrations of hydrogen peroxide than previously reported.

The following examples are presented by way of illustration to show the significant increase in current efficiency in the production of hydrogen peroxide in concentrations usable directly in the wood pulp industry and to compare the process and apparatus of the present invention utilizing reticulated vitreous carbon foam to prior art processes utilizing packed carbon beds to show the improvement thereover.

EXAMPLE I

Two cells were prepared in accordance with the electrolytic cell shown in FIG. 2 with one having a cathode bed utilizing approximately 78 grams of −10 to +16 mesh Ultra "F" graphite chips, and another utilizing approximately 3½ grams of reticulated vitreous carbon obtained from Fluorocarbon Company of Anaheim, Calif. The bed dimensions in both examples were approximately 3 to 4 millimeters thick, five centimeters wide and approximately 50 centimeters high. The cells were operated with countercurrent flow of the electrolytes flowing through the cathode compartment and the anode compartment, respectively, with oxygen being introduced into the electrolyte flowing through the cathode compartment. Operating conditions for the cells were as follows:

| PACKED GRAPHITE BED ELECTRODE CELLS | |
|---|---|
| Electrolyte | 2 M NaOH |
| Gas | Oxygen |
| Electrolyte Flow | 7 ml/min ± 1.0 |
| Oxygen Flow | 5 ± 1 l/min |
| Cell Pressure | 250 psig |
| Electrolyte Temperature | 27 ± 2° C. |
| Graphite Packed Bed Cathode | 5 × 50 × 0.3 cm |
| **RETICULATED VITREOUS CARBON FOAM ELECTRODE CELLS** | |
| Electrolyte | 2 M NaOH |
| Gas | Oxygen |
| Electrolyte Flow | 7 ml/min ± 1.7 |
| Oxygen Flow | 5 ± 1 l/min |
| Cell Pressure | 250 psig |
| Electrolyte Temperature | 30° C. ± 1 |
| Reticulated Vitreous Carbon Cathode | 5 × 50 × 0.3 cm |

Table I compares the performance of the reticulated vitreous carbon electrode to the packed graphite bed electrode.

TABLE I

| | Current Density $A/m^2$ | Cell Voltage | NaOH Flow, ml/min | Wt % $H^2O^2$ | % Current Efficiency |
|---|---|---|---|---|---|
| Graphite | 200 | 1.7 | 7.8 | 0.56 | 89 |
| RVC | 200 | 1.7 | 8.7 | 0.51 | 90 |
| Graphite | 400 | 2.6 | 6.0 | 0.97 | 59 |
| RVC | 400 | 2.3 | 5.6 | 1.53 | 87 |
| Graphite | 600 | 3.0 | 6.4 | 0.81 | 35 |
| RVC | 600 | 2.6 | 6.2 | 2.03 | 86 |
| Graphite | 800 | 3.7 | 7.0 | 0.64 | 23 |
| RVC | 800 | 2.8 | 7.2 | 2.32 | 85 |

It is evident from Table I that at high current densities the reticulated vitreous carbon foam electrode cells produce over two weight percent hydrogen peroxide at current efficiencies of approximately 85%. This should be compared to the results in U.S. Pat. No. 3,969,201 wherein current efficiencies are reported in the neighborhood of 70% but for the production of only 0.048 weight percent of hydrogen peroxide, an insignificant amount. As reported in the referenced patent, 21% efficiency is accomplished at a hydrogen peroxide concentration of 0.5 weight percent which is significantly less than the percentage of hydrogen peroxide necessary for the utilization thereof in the paper pulp industry directly from such a series of cells. Based on the weight percent reportedly produced by the subject patent at approximately 21% current efficiency, it is evident that the apparatus and process of the present invention produces significantly more hydrogen peroxide at higher current efficiencies and is attributed to the use of a particular reticulated vitreous carbon cathode. In fact, based on a current efficiency of 75–80% producing approximately 2.2% $H_2O_2$, only about 475 cells would be required to meet the demand of a typical wood pulp plant as discussed earlier. This compares to approximately 2100 cells of the packed carbon bed type and hence only about one fourth the space is required for cells made in accordance with the present invention compared to a packed bed cell.

Although there has been described a specific process and apparatus for the production of hydrogen peroxide in an electrolytic cell, in accordance with the invention for the purposes of illustrating the manner in which the invention may be used to advantage, it would be appreciated that the invention is not limited thereto. Accordingly, and in all modifications, variations or equivalent arrangements which may occur to those skilled in the art should be considered to be within the scope of the invention as defined in the appended claims.

What is claimed is:

1. An electrolytic process for producing hydrogen peroxide in an aqueous alkaline solution comprising:

(a) simultaneously passing an aqueous alkaline electrolyte and oxygen through a fluid permeable cathode comprising reticulated vitreous carbon foam;

(b) separating said fluid permeable cathode from an anode by a barrier wall; and, (c) connecting said fluid permeable cathode and said anode with an external power source for causing the electrical current density on the fluid permeable cathode to be at least 400 amperes per square meter and generating hydrogen peroxide ion within the aqueous alkaline solution, at a current efficiency of at least 85 percent.

2. An electrolytic process for producing hydrogen peroxide in an aqueous alkaline solution comprising:

(a) simultaneously passing an aqueous alkaline electrolyte and oxygen through a fluid permeable cathode comprising reticulated vitreous carbon foam;

(b) separating said fluid permeable cathode from an anode compartment by a barrier wall;

(c) passing an aqueous alkaline electrolyte through the anode compartment; and, (d) connecting said fluid permeable cathode and said anode with an external power source for causing the electrical current density on the fluid permeable cathode to be at least 400 amperes per square meter and generating hydrogen peroxide ion within the aqueous alkaline solution, at a current efficiency of at least 85 percent.

3. The process of claim 1 or 2 wherein the barrier wall comprises a membrane impermeable to $HO_2^-$ and $OH^-$ ions.

4. The process of claim 3 wherein the barrier wall comprises Nafion.

5. An electrolytic process for producing hydrogen peroxide in a sodium hydroxide solution comprising:

(a) introducing oxygen into an aqueous sodium hydroxide solution to form an electrolyte;

(b) passing said electrolyte at a pressure of approximately 250 psig through a fluid permeable cathode comprising reticulated vitreous carbon foam;

(c) separating said fluid permeable cathode from an anode compartment by a membrane impermeable to $HO_2^-$ and $OH^-$ ions;

(d) passing sodium hydroxide solution through the anode compartment;

(e) connecting said fluid permeable cathode and said anode with an external power source for causing electrical current to flow through, between the fluid permeable cathode and the anode in a direction perpendicular to the direction of the flow of electrolyte through the fluid permeable cathode, causing the electrical current density on the fluid permeable cathode to be at least 400 amperes per square meter and generating hydrogen peroxide ion within the aqueous alkaline solution at a current efficiency of at least 85 percent; and, withdrawing from the fluid permeable cathode, sodium hydroxide solution having at least 1.5 percent by weight hydrogen peroxide therein.

* * * * *